United States Patent [19]

Emmerich

[11] Patent Number: 4,484,783

[45] Date of Patent: Nov. 27, 1984

[54] RETAINER AND WEAR SLEEVE FOR ROTATING MINING BITS

[75] Inventor: Kenneth C. Emmerich, Lexington, Ky.

[73] Assignee: Fansteel Inc., North Chicago, Ill.

[21] Appl. No.: 400,733

[22] Filed: Jul. 22, 1982

[51] Int. Cl.[3] ..... E21C 25/38

[52] U.S. Cl. ..... 299/86; 411/508; 411/15; 299/92; 175/354

[58] Field of Search ..... 299/86, 92; 83/698; 37/142 A; 279/79, 80, 93, 94, 95, 96, 19.7; 411/508, 521, 60, 61, 15; 403/326, DIG. 1; 175/415, 354, 410

[56] References Cited

U.S. PATENT DOCUMENTS

| | | | |
|---|---|---|---|
| Re. 29,900 | 2/1979 | Kniff | 299/92 |
| 3,767,266 | 10/1973 | Krekeler | 299/92 |
| 3,820,848 | 6/1974 | Kniff | 175/354 |
| 4,201,421 | 5/1980 | Den Besten | 299/86 |
| 4,368,789 | 1/1983 | Orr | 175/415 |

FOREIGN PATENT DOCUMENTS

| | | | |
|---|---|---|---|
| 3019422 | 12/1980 | Fed. Rep. of Germany | 175/354 |

*Primary Examiner*—James A. Leppink
*Assistant Examiner*—Michael Starinsky
*Attorney, Agent, or Firm*—Barnes, Kisselle, Raisch, Choate, Whittemore & Hulbert

[57] ABSTRACT

A mining bit to be mounted for rotation in a bore of a support block or on a drill steel having a retention configuration opposite the working end. A bit shank is formed with an abutment flange at the insertion end and a recess adjacent said flange to receive flexed resilient fingers of a resilient retention ring during insertion of said ring in said bore. A fulcrum land supports an unsplit end of said ring. The resilient fingers carry an annular bulge projection which engages an annular recess in a support bore. The ring can extend the length of the retention shank to serve as a wear sleeve. With a drill steel, the retention ring is mounted on an extending insert to cooperate with a female recess in a hollow bit.

10 Claims, 11 Drawing Figures

RETAINER AND WEAR SLEEVE FOR ROTATING MINING BITS

FIELD OF INVENTION

The invention relates to mining bits which are removably positioned in support blocks or on a drill steel and more particularly to resilient retaining devices for the bits and to wear sleeves serving also as retention units.

BACKGROUND OF INVENTION

In the field of mining, large power operated machines carry a multiplicity of moving support blocks which carry ore or coal contacting bits usually referred to as pick bits. See, for example, U.S. Pat. No. 3,663,063; issued May 16, 1972 to Johanmeyer. Some of these bits are mounted with rectangular shanks and retained by various resilient clips. In many cases, however, these bits have a supporting shank which is circular in cross-section, the shank being supported in a block having a circular bore dimensioned such that the bit can rotate in its support. This rotation equalizes the wear around the bit and results in a longer life.

Circular bits of the type above described have, in some instances, been removably retained in the support socket by a split resilient retention ring which is lodged in an annular recess in the circular shank of the bit. The ring will compress circumferentially to allow it to pass into a support bore and has protuberances which expand into an annular recess in the wall of a bore which will provide axial engagement to retain the bit while permitting it to rotate in use. The U.S. Pat. No. 3,519,309, to Engel et al, issued July 7, 1970, illustrates a split ring resilient retainer of this type.

More recently a U.S. Pat. No. 4,201,421 to Den Besten et al, (May 6, 1980) has issued disclosing a combination retainer and wear sleeve which has an expanded dimension greater than the bore into which it is to be inserted and the bit shank has a shoulder to contact one end of the sleeve in a manner to retain the bit in the support bore due to the resilient frictional contact between the sleeve and the wall of the bore.

The present invention contemplates an improved split retention ring which can also serve as a wear sleeve. The retention ring is split at one end into a plurality of resilient projections separated by axial slots such that the resilient movement to enable the ring to move into a bore is in the projections and does not involve to any significant degree the basic circumferential resilience of the ring itself.

The construction of the resilient ring requires a stepped diameter construction in the bit shank such that a portion of the ring is supported on a larger diameter, and a smaller diameter portion directly adjacent the larger diameter is provided to receive the resilient projections when moved to an insertion position by the pressure of the wall of the bore. Upon reaching the operating position, the projections return to their normal circumferential position to have axial contact with an annular shoulder on the bit shank.

The improved design can utilize an almost continous collet enlargement to provide maximum wear area and thus is an improvement over the split rings which utilized localized protrusions which are easily damaged. A more rugged construction is thus possible while improved retention and bit rotation results.

The retention ring can also be applied to an extension of a drill steel to cooperate with a hollow drill bit such as used for drilling holes for roof support means in mining applications.

Other objects and features of the invention will be apparent in the following specification, including the claims in which the invention is described together with details to enable persons skilled in the art to practice the invention, all in connection with the best mode presently contemplated for the invention.

BRIEF DESCRIPTION OF THE DRAWINGS

DRAWINGS accompany the disclosure and the various views thereof may be briefly described as.

DETAILED DESCRIPTION OF THE INVENTION AND THE MANNER AND PROCESS OF USING IT

Figure 1:
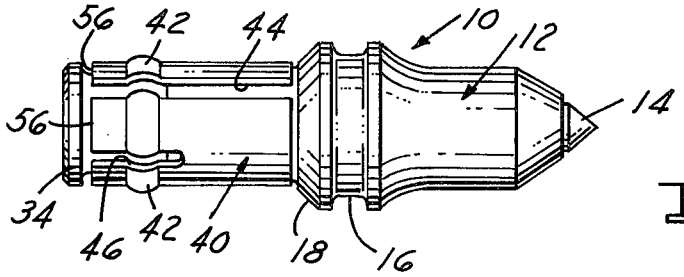
FIG. 1, a side elevation of a bit and wear sleeve retainer assembly.
Figure 3:
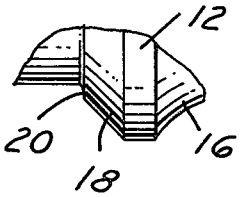
FIG. 3, an enlarged view of the bit shoulder.
Figure 2:
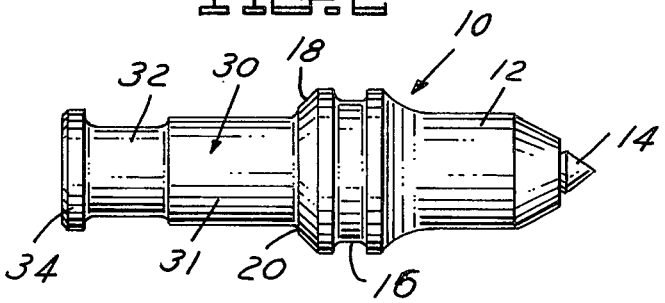
FIG. 2, a view of a bit without the retainer.

With reference to the embodiment illustrated in FIGS. 1 to 6, the rotary type pick bit 10 has a body portion 12 with a hardened point insert 14, such as tungsten carbide and a pryout groove 16. The body 12 terminates at the left end in a chamfer which drops off to a radial shoulder 20. To the left of the shoulder 20 is a retaining shank 30 with a land 31 reduced in diameter from the shoulder 20 and extending to an annular recess 32 which terminates in a retention flange or abutment 34 at the insertion end of the tool. The diameter of the flange 34 is about that of the larger diameter of the shoulder 20. A radius is left between the shoulder and the shank 30.

Figure 11:
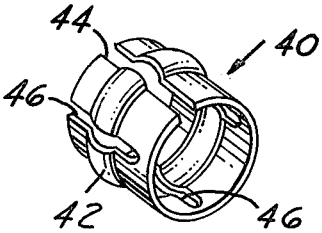
FIG. 11, an isometric view of a retention ring.

The retention device for the combination comprises a sleeve 40 formed of resilient material such as hardened and tempered steel with an annular rounded bulge 42 serving as a retention ring. The sleeve has an axial split 44 extending for its full length and a plurality of shorter slots 46 extending from the left end of the sleeve as viewed in the drawings to a point through the annular ring bulge 42 and a little beyond. In the example shown, there are three slots 46. For example, a sleeve 1.288" long may have the center of the ring bulge 42 a distance of 0.322" from the left end, as viewed in the drawings, and the slots 46 terminate 0.562" from the left end or 0.240" from the center of the bulge ring 42. In each embodiment, the retention rings are cut out as a flat stock and formed, shaped, and heat treated by hardening and tempering. The bulge has, in cross-section, a radius of about 0.090" blended into the walls of the ring to provide a cammming surface. The flat stock can be, as an example, 0.035" in thickness. An isometric view of the retention sleeve 40 is shown in FIG. 11.

Figure 5:
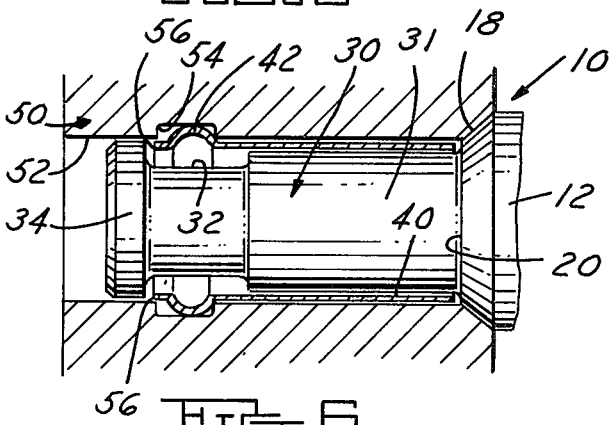
FIG. 5, a partial longitudinal section of the bit and retention ring assembly in the support block.

The at-rest diameter of the retention sleeve 40 is such that the sleeve must be expanded temporarily to allow it to slip over the retention flange 34 to the assembled positions shown in FIGS. 1 and 5. In FIG. 5 a support block 50 is shown with a bore 52 to receive and support a mining bit.

Figure 6:
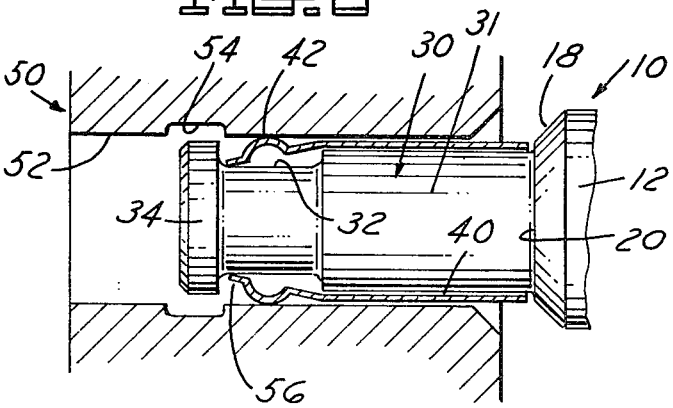
FIG. 6, a partial sectional view showing the assembly of the bit and retentin ring during insertion into the support block.

After the sleeve 40 is assembled onto the shank 30 of the bit, the assembly may be driven into the bore 52, the flange 34 serving as a pilot. As the split end of the retention sleeve enters the bore, the right-hand end bears against shoulder 20 and the rounded bulge is cammed inwardly, as shown in FIG. 6. The ends of the sleeve (flexing fingers) between the slots 46 bend inwardly from the land 31 into annular recess 32 around the end of the fulcrum land portion 31 of the retention shank. The bore 52 has an annular enlargement recess 54 into which the ring bulge portions 42 will lodge when the sleeve reaches the seated position. This is shown in FIG. 5. In this position, the ends 56 are axially adjacent the outer periphery of the abutment flange 34. Thus, with the ring bulge 42 in annular recess 54 and the ends 56 abutting flange 34, the bit is locked in place. The expanded position of the sleeve 40 is such that it has an O.D. (outer diameter) smaller than bore 52 and an I.D. (inner diameter) larger than the shank 30. Thus, the bit can rotate readily in the bore while being mechanically retained. Thus, no frictional retention is required between the retention ring and the confining recess.

Figure 7:
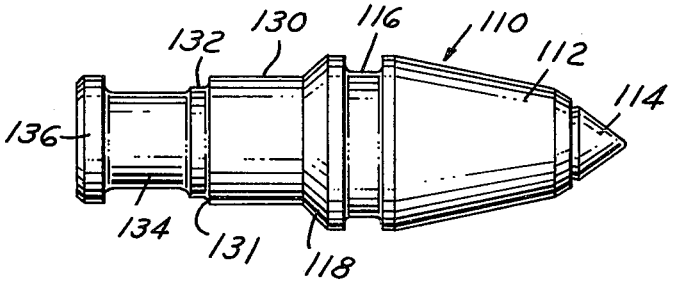
FIG. 7, another embodiment of the shank on a bit for use with a short retention ring.
Figure 8:
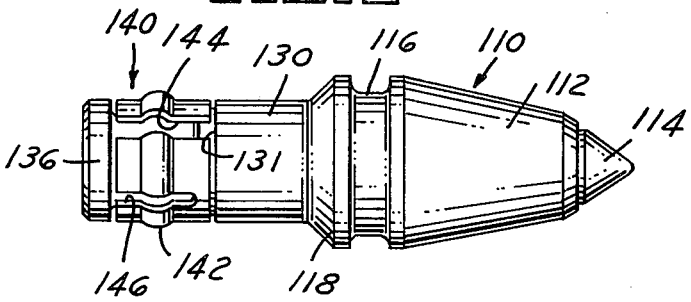
FIG. 8, an assembly illustrating the bit of FIG. 7 with the short retention ring.

The embodiment in FIGS. 7 and 8 is the same in principle as that described above. A mining bit 110 has a body 112 and a wear tip 114. A pryout groove 116 is provided. The body 112 tapers down at 118 to a retention shank 130 which is stepped down at shoulder 131 to an axially extending fulcrum land 132. A further reduction in diameter provides an annular recess 134 which ends at a retention abutment flange 136 at the insertion end of the tool.

Figure 4:
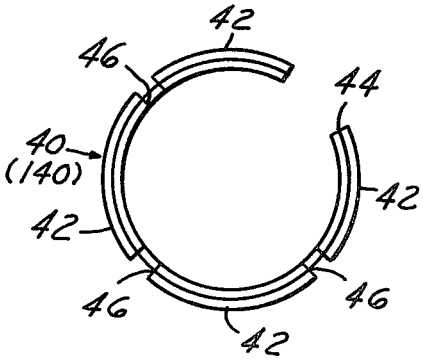
FIG. 4, an end view of a retention ring (retainer)

The retention sleeve or ring in this embodiment is shorther than that previously described but operates on the same principle. The ring 140 has an axial slot 144 to allow expansion over the flange 136. It also has a plurality of slots 146 extending through the bulge ring 42 but short of the right end of the ring. FIG. 4 is an end view of the ring 140 as well as ring 40.

In assembly, the ring 140 is expanded over flange 136 to assemble it on the bit. When the bit is driven into the bore of a support block, the righthand end of the ring will seat against shoulder 131 and position on the fulcrum land 132 and the portions (flexing fingers) adjacent the slots will fulcrum (deflect inwardly) into recess 134 until the ring bulge 142 reaches the annular recess 54 in a support block. Then the ring will expand and retain the bit as before.

As an example, the retention ring 140 may be 0.625" long and the center of the bulge may be 0.400" from the one end of the ring. The plurality of short slots are 0.470" long and extend to within 0.155" of the end of the ring. In each case, the radius of the bulge in cross-section is about 0.090". While the examples show three slots 46, one or more could be used depending on the size of the ring.

The embodiment in FIGS. 1 to 6 may serve as a wear sleeve as well as a retainer to protect the shank of the bit against excessive abrasion. Both embodiments provide a comparatively large annular area in the ring bulge 42 to serve as a retainer. The cam surfaces of the ring bulge allow the bits to be moved in and out without destruction of the wear surfaces and with minimal wear on the wall of the bores of the support blocks.

In each embodiment, the fulcrum land 31 or the fulcrum and 132 will preferably have a diameter smaller than the effective diameter of the abutment flange 34 or 136. A smaller abutment flange could be used with a reduced diameter of the split end of the retention rings. The abutment is most simply formed as a continuous flange but could be interrupted as a series of circumferential abutments and still perform effectively.

Figure 9:
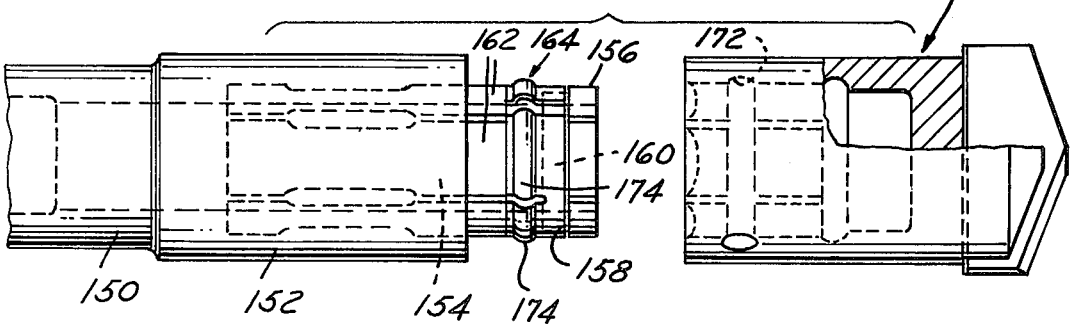
FIG. 9, a partial exploded view of the retention ring used on a drill steel for connection to a hollow drill bit.
Figure 10:
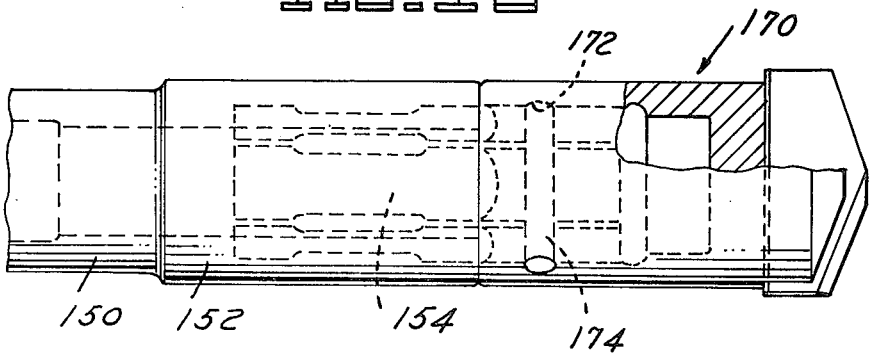
FIG. 10, a view of the assembly of the parts in FIG. 9.

In the previous description, the retention ring is shown used with a support block in combination with a bit. In FIGS. 9 and 10, the retainer is shown used with a drill steel and a roof drill bit used in roof drilling and other mining operations.

A driving drill steel 150 having an enlarged end 152 carries an insert 154 which is hot forged into place. This procedure is disclosed in U.S. Pat. No. 4,299,510 to Emmerich and Chrise, dated Nov. 10, 1981. The insert 154 projects from the end of the drill steel. This insert has an extending end with an annular abutment enlargement 156 which forms a shoulder 158 progressing inwardly to a fulcrum land 160 which drops off to an annular clearance recess providing radial clearance for the flexing fingers 162 of a retention ring (retainer) 164.

The bit 170 has a hollow center with an annular groove 172 to receive the ring bulge portion (annular rib) 174 on the flexing fingers 162 of the retention ring during assembly.

Thus, when the hollow bit 170 is driven onto the extension element 154 with the retainer 164 in place, the flexing fingers 162 will move inwardly as previously described in connection with the embodiments of FIGS. 1 to 8. When the annular ribs 174 reach the groove 172, the resilient fingers 162 will expand and lock the bit onto the drill steel. The left-hand end of fingers 162 will abut the end of the drill steel and the shoulder at the left end of the annular clearance recess as the fingers are moved radially inward during the insertion process. Because of the rounded nature of the ribs 174, a camming action will take place during the insertion or removal of the bit. As previously referenced, an isometric view of the retention ring is shown in FIG. 11.

I claim:

1. In combination, a mining tool bit element, a bit support element, one of said elements having a retention shank and the other of said elements having a shank receiving bore, and a retention ring mecanically associating the bit element and the bit support element in telescoping relation for rotation which comprises:

(a) a retention shank on one end of said elements having axially opposed abutment radial shoulders, a fulcrum land axially adjacent one of said shoulders of lesser diameter than the outer diameter of said shoulders, and an annular recess formed adjacent the other of said shoulders having a diameter less than that of said fulcrum land, (b) a retention ring of resilient material mounted between said shoulders on said retention shank around said fulcrum land and said recess, said ring having a plurality of resilient fingers at the end opposite said fulcrum land radially movable into said recess upon insertion or removal, and (c) means on said fingers to extend radially outward of said ring to engage the interior wall of the other of said elements.

2. A combination as defined in claim 1 in which said means on said fingers comprises an annular rounded bulge interrupted by axial slots between said fingers.

3. A combination as defined in claim 1 in which one of said elements includes a support block having a bore and an annular recess in the wall of said bore to engage said means on said fingers.

4. A combination as defined in claim 1 in which one of said elements comprises a mining bit having a working portion terminating in one of said radial shoulders and said retention ring extends axially over said retention shank on said bit between said shoulders to serve as a wear sleeve for said retention shank.

5. A combination as defined in claim 1 in which one of said elements is a driving drill steel and said retention shank is formed on the end of said driving drill steel, and the other element comprises a hollow bit having a female recess and internal annular groove formed in the inner wall of said recess to receive said shank and said retention ring.

6. A tool as defined in claim 1 in which one of said elements comprises a drill steel with the retention shank extending from one end thereof, and the other of said elements comprises a mining tool bit having a working end and a retention end, said retention end having a recess formed therein to receive said retention ring mounted on said shank.

7. A tool to be supported in a bore of a support block in which an elongate tool has a working end to project out of said bore and a round retention shank to be received in said bore which comprises:

a tool having a retention with an insertion end opposite the working end, an abutment flange at said insertion end having a first annular shoulder facing the working end, an annular fulcrum land on said shank, an annular recess having one end formed by said first annular shoulder and the other end formed by a second annular shoulder rising radially to said annular fulcrum land on said shank, and a third annular shoulder rising from said fulcrum land in axial opposition to the outer portion of said first annular shoulder.

8. A tool as defined in claim 7 in which said abutment flange has a largest diameter on said shank, said fulcrum land has an intermediate diameter smaller than that of said abutment flange, and said annular recess has a diameter smaller than said fulcrum land.

9. A tool as defined in claim 7 in which said third annular shoulder is formed out from said fulcrum land facing said first annular shoulder having an inner diameter equal to said land and an outer diameter substantially equal to the diameter of said first annular shoulder on said abutment flange.

10. A retention ring for tools having a projection working end and a retention end which comprises:

a ring of resilient material, split axially for expansion assembly onto a retention shank, a formed annular bulge rounded in cross-section formed adjacent one end of said ring, and axial slots at said one end of said ring extending through said annular bulge to form resilient fingers at said one end of said ring.

* * * * *

UNITED STATES PATENT AND TRADEMARK OFFICE

CERTIFICATE OF CORRECTION

PATENT NO. : 4,484,783

DATED : November 27, 1984

INVENTOR(S) : Kenneth C. Emmerich

It is certified that error appears in the above-identified patent and that said Letters Patent are hereby corrected as shown below:

Col. 6, Line 1, after "retention" insert -- shank --.

Col. 6, Line 10, delete "in axial opposition to" and insert in place thereof -- facing --.

Col. 6, Line 11, after "shoulder" but before the period (.) insert -- and having a portion radially coextensive with said first annular shoulder --.

Signed and Sealed this

Fourth Day of June 1985

[SEAL]

*Attest:*

DONALD J. QUIGG

*Attesting Officer* *Acting Commissioner of Patents and Trademarks*